US010610022B2

(12) United States Patent
Donovan

(10) Patent No.: US 10,610,022 B2
(45) **Date of Patent: *Apr. 7, 2020**

(54) HEADREST TILT MECHANISM

(71) Applicant: L&P PROPERTY MANAGEMENT COMPANY, South Gate, CA (US)

(72) Inventor: Robert Dean Donovan, Mooreville, MS (US)

(73) Assignee: L&P Property Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/641,978

(22) Filed: Jul. 5, 2017

(65) Prior Publication Data

US 2017/0295937 A1 Oct. 19, 2017

Related U.S. Application Data

(63) Continuation of application No. 14/854,197, filed on Sep. 15, 2015, now Pat. No. 9,730,522.

(60) Provisional application No. 62/114,166, filed on Feb. 10, 2015, provisional application No. 62/055,771, filed on Sep. 26, 2014.

(51) Int. Cl.

| | |
|---|---|
| ***A47C 7/38*** | (2006.01) |
| ***A47C 1/036*** | (2006.01) |
| ***A47C 1/02*** | (2006.01) |

(52) U.S. Cl.

CPC ..... *A47C 7/38* (2013.01); *A47C 1/02* (2013.01); *A47C 1/036* (2013.01)

(58) Field of Classification Search

None

See application file for complete search history.

(56) References Cited

U.S. PATENT DOCUMENTS

| | | | |
|---|---|---|---|
| 3,836,198 | A | 9/1974 | Mizelle |
| 3,890,000 | A | 6/1975 | Easley |
| 4,896,918 | A | 1/1990 | Hoshihara |

(Continued)

FOREIGN PATENT DOCUMENTS

| | | | |
|---|---|---|---|
| CN | 1618656 | A | 5/2005 |
| EP | 2039270 | A1 | 3/2009 |
| JP | H04102409 | A | 4/1992 |

OTHER PUBLICATIONS

Non-Final Office Action dated Jul. 14, 2017 in U.S. Appl. No. 15/251,242, 16 pages.

(Continued)

*Primary Examiner* — David E Allred

(74) *Attorney, Agent, or Firm* — Shook, Hardy & Bacon L.L.P.

(57) ABSTRACT

A headrest tilt mechanism is provided for installation on a chair. The mechanism includes a back insert that frames an area of the chair to be independently pivoted. A pair of spaced headrest tilts are coupled to the back insert, and pivotally coupled to the back frame of the chair. A lower connector tube is coupled to the back frame of the chair below the back insert. A linkage coupler is pivotally coupled to an upper member at an upper pivot point and is pivotally coupled an actuator at a lower pivot point. The upper member has a secured leg secured to the pair of spaced headrest tilts and a pivotal leg pivotally coupled to the linkage coupler. An actuator is pivotally coupled between the linkage coupler and the lower connector tube that can be actuated to pivot the headrest tilts from a closed to an open position.

10 Claims, 14 Drawing Sheets

(56) References Cited

U.S. PATENT DOCUMENTS

| | | | |
|---|---|---|---|
| 5,466,045 | A | 11/1995 | Akima |
| 5,718,476 | A | 2/1998 | De Pascal et al. |
| 5,927,804 | A | 7/1999 | Cuevas |
| 6,045,181 | A | 4/2000 | Ikeda et al. |
| 6,619,739 | B2 | 9/2003 | McMillen |
| 6,824,214 | B2 | 11/2004 | McMillen |
| 6,962,392 | B2 | 11/2005 | O'Connor |
| 7,077,476 | B2 | 7/2006 | McMillen |
| 7,097,246 | B2 | 8/2006 | Sedlatschek et al. |
| 7,195,313 | B2 | 3/2007 | Hippel et al. |
| 7,845,729 | B2 | 12/2010 | Yamada et al. |
| 8,042,415 | B2 | 10/2011 | Ito |
| 8,262,164 | B2 | 9/2012 | Ito et al. |
| 8,590,964 | B2 | 11/2013 | Murphy et al. |
| 8,622,467 | B2 | 1/2014 | Murphy et al. |
| 8,979,186 | B2 | 3/2015 | Walz et al. |
| 9,282,827 | B1 | 3/2016 | Lu |
| 9,486,079 | B2 | 11/2016 | Romero |
| 9,521,907 | B2 | 12/2016 | Romero |
| 2002/0195846 | A1 | 12/2002 | Masuda et al. |
| 2004/0195895 | A1 | 10/2004 | Sedlatschek et al. |
| 2005/0062330 | A1 | 3/2005 | Eberle et al. |
| 2005/0077771 | A1 | 4/2005 | May |
| 2007/0278837 | A1 | 12/2007 | White et al. |
| 2008/0012414 | A1 | 1/2008 | Dewert |
| 2009/0079245 | A1 | 3/2009 | Marcantoni |
| 2010/0140999 | A1 | 6/2010 | Kladde |
| 2012/0001461 | A1 | 1/2012 | Alexander et al. |
| 2012/0086256 | A1 | 4/2012 | Adams et al. |
| 2013/0134761 | A1 | 5/2013 | Willard et al. |
| 2014/0054944 | A1 | 2/2014 | Locke et al. |
| 2014/0203611 | A1 | 7/2014 | Kondrad et al. |
| 2016/0088945 | A1 | 3/2016 | Lu |
| 2016/0096448 | A1 | 4/2016 | Line et al. |
| 2016/0129816 | A1 | 5/2016 | Lee et al. |
| 2016/0227934 | A1 | 8/2016 | Lu |
| 2016/0345740 | A1 | 12/2016 | Lu |

OTHER PUBLICATIONS

International Preliminary Report on Patentability dated Aug. 24, 2017 for International Patent Application No. PCT/US2015/015558, 5 pages.

Search Report and Written Opinion dated May 4, 2018 in European Patent Application No. 17187070.2, 9 pages.

Communication pursuant to Article 94(3) dated Jan. 17, 2019 in European Patent Application No. 17187070.2, 4 pages.

Communication under Rule 71(3) dated Jan. 24, 2019 in European Patent Application No. 15843565.1, 28 pages.

HEADREST TILT MECHANISM

CROSS-REFERENCE TO RELATED APPLICATIONS

This application is a continuation of U.S. application Ser. No. 14/854,197 filed on Sep. 15, 2015, entitled "HEADREST TILT MECHANISM", which claims the benefit of U.S. Provisional Application No. 62/114,166, filed on Feb. 10, 2015, entitled "HEADREST TILT MECHANISM" and U.S. Provisional Application No. 62/055,771, filed on Sep. 26, 2014, entitled "HEADREST TILT MECHANISM". The teachings of U.S. application Ser. Nos. 14/854,197, 62/114,166 and 62/055,771 are hereby incorporated by reference in their entirety.

STATEMENT REGARDING FEDERALLY SPONSORED RESEARCH OR DEVELOPMENT

Not applicable.

TECHNICAL FIELD

Embodiments of the present invention relate to headrest mechanisms, and particularly to headrest mechanisms for use on reclining seating units.

BACKGROUND OF THE INVENTION

Conventional recliner chairs typically incorporate mechanisms to move the chair into three basic positions: closed, with the footrest retracted and the back generally upright, a "TV position" with the footrest extended and the back generally upright, and reclined, with the footrest extended and the back in a reclined position.

One feature that may add to the comfort of users of these conventional recliners is a moveable headrest. The moveable headrest feature allows the head portion of the chair back to pivot with respect to the remainder of the back. This may increase the comfort of a person, especially in the reclined position, as rotation of the headrest provides supports the head of the user and can be adjusted to the most-comfortable position.

While moveable headrests have been provided, it is desirable to provide a simplified structure, capable of installation on any number of styles of chairs, while still providing the adjustment needed to enhance the comfort of those using the chair.

BRIEF DESCRIPTION OF THE INVENTION

A simplified headrest tilt mechanism is disclosed that is operable to move a headrest portion of a chair back between a closed position generally in line with a chair back, and an open position in which the headrest is pivoted with respect to the chair back.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Figure 1:
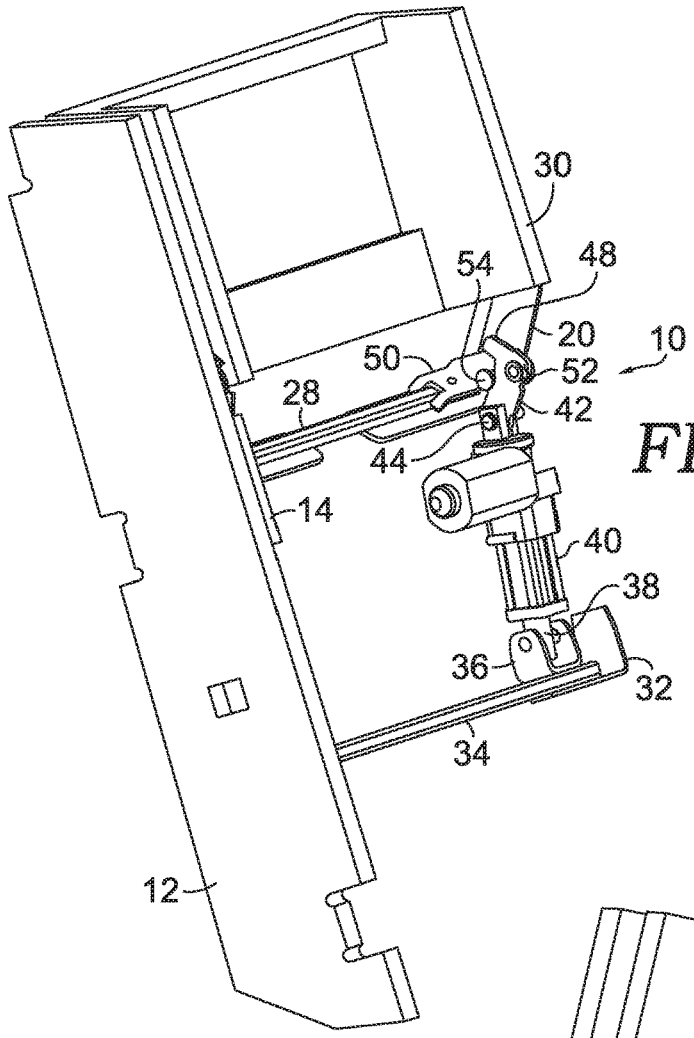
FIG. 1 is a perspective view of an exemplary headrest tilt mechanism in a closed position, with only a portion of a chair frame shown for clarity, in accordance with an embodiment of the invention.
Figure 2:
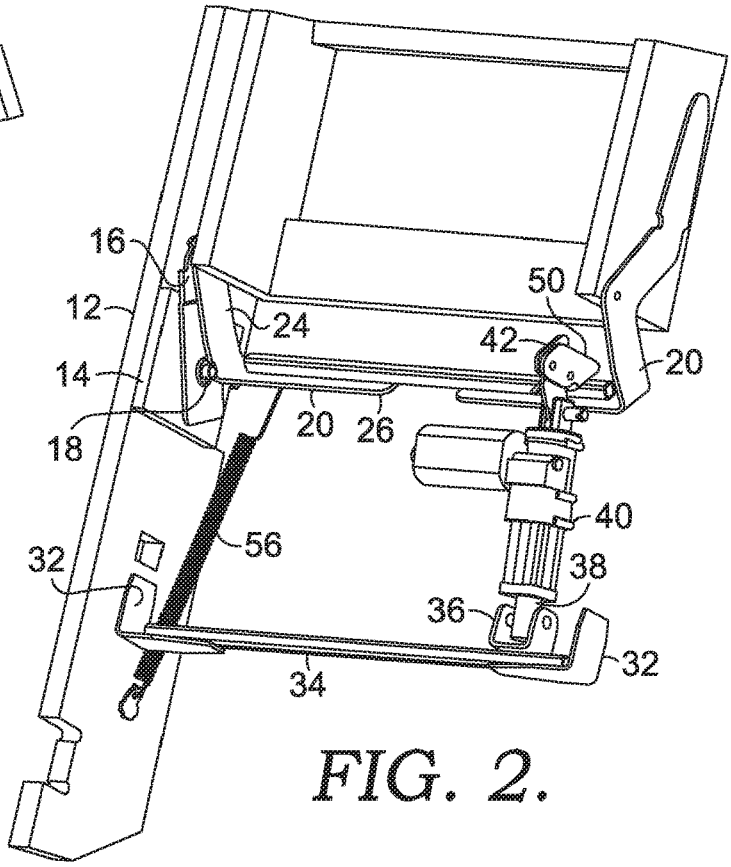
FIG. 2 is a perspective view similar to FIG. 1, from a different angle.
Figure 3:
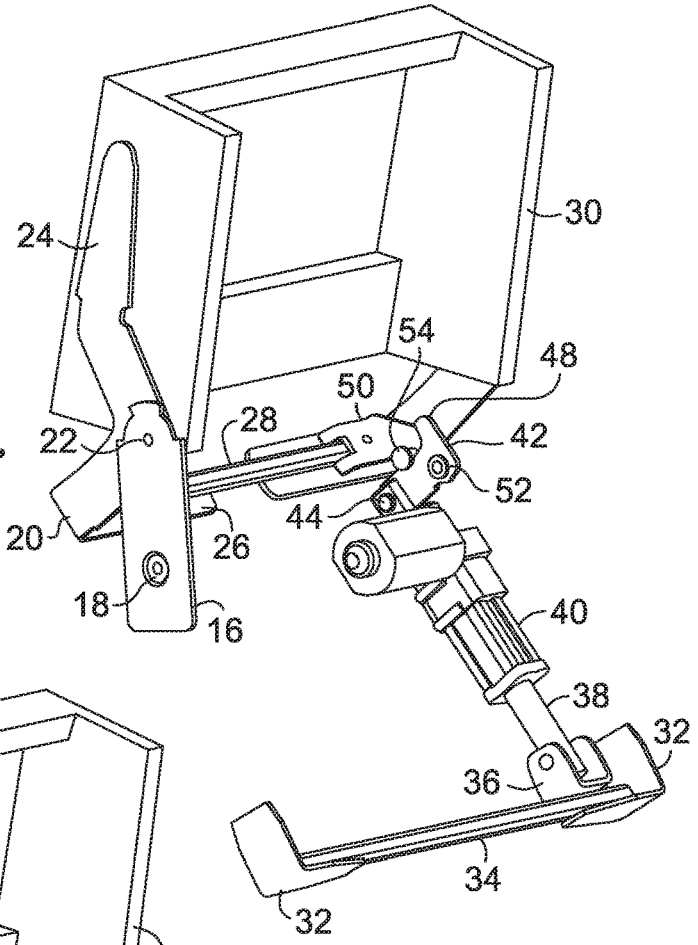
FIG. 3 is a perspective view similar to FIG. 1, with the mechanism in an open position, and with the back frame post removed to show the pivot point.

Embodiments of the present invention generally relate to a moveable headrest or head tilt mechanism for use on a recliner chair or other item of furniture. With initial reference to FIG. 1, an exemplary headrest tilt mechanism 10 is shown that moves the head portion of the chair between the closed position, shown in FIGS. 1 and 2, to the open position, shown in FIG. 3. The mechanism 10 is installed into the chair by mounting it to a back frame post 12 that forms the frame for the back of the chair. Only one back frame post 12 is shown in the figures for clarity, but in practice, a second back frame post will be present to support the other side of the chair back. Only a portion of the chair frame is shown, but those with skill in the art would readily understand that back frame post 12 forms only a part of the entire chair frame. Mechanism 10 is mounted to back frame post through a back post spacer block 14. Block 14 is rigidly secured to the inner face of the back frame post 12. A back bracket 16 is then rigidly secured to the back post spacer block 14, such as by screws or bolts, although other methods of attachment would work. Back bracket 16 extends forwardly and upwardly. A stop 18 is either formed in, or coupled to, back bracket 16 at the lower end of the back bracket 16. A headrest tilt 20 is pivotally coupled to the upper end of back bracket 16 at pivot 22 (as shown in FIG. 3). Headrest tilt 20 is shaped as shown with an upwardly extending leg 24 and an inwardly extending leg 26. As shown, there are two headrest tilts 20, one a mirror-image of the other. A top connector tube 28 is coupled to each inwardly extending leg 26 to secure the two headrest tilts 20 together. The connector tube 28 may include a series of spaced holes along its length to allow for width changes in the chair back to which mechanism 10 is attached. A back insert 30 is coupled between the upwardly extending legs 24 of the headrest tilts 20. The back insert 30 is a rigid frame that, in practice, will be finished with support, padding and a cover.

Figure 5:
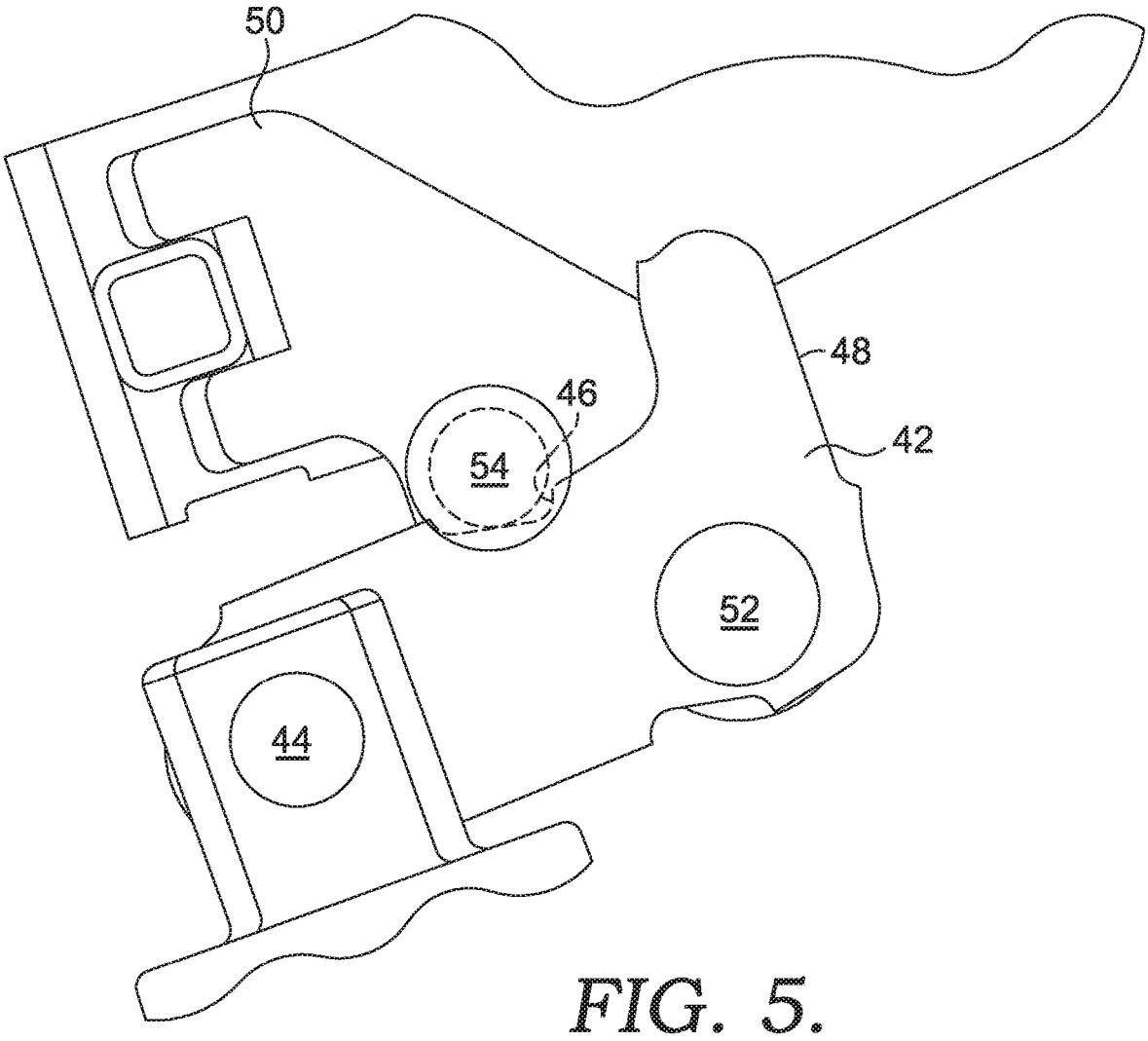
FIG. 5 is an enlarged view showing the relationship of the motor slide hinge, the motor slide bracket and the cam.

A bottom bracket 32 is coupled to the back frame post 12, spaced downwardly from back bracket 16. As shown, the mechanism 10 includes two bottom brackets 32, each a mirror-image of the other. A bottom connector tube 34 is rigidly secured to each bottom bracket 32 and forms a lower brace for the mechanism 10. More specifically, a clevis 36 is coupled to the connector tube 34 such as by bolts, rivets or welding. The shaft 38 of a motor 40 is then pivotally coupled to the clevis 36. The motor shown in the figures could also be any other type of motor, linear actuator or gas spring, capable of the movements described below. The upper end of motor 40 is pivotally coupled to back area of a motor slide hinge 42 at pivot 44. Motor slide hinge 42 has an upper surface with a locating notch 46, as best seen in FIG. 5. Additionally, motor slide hinge 42 includes a retaining finger 48 that extends upwardly. The retaining finger 48 operates to prevent the mechanism geometry from entering an over-center condition, retaining the stop pin 54 in the desired area. The forward area of motor slide hinge 42 is pivotally coupled to a motor slide bracket 50 at pivot 52. Motor slide bracket 50 is generally L-shaped. One leg of the L is pivotally coupled to the motor slide hinge 42. The other leg of the L is rigidly secured to the adjacent inward leg 26 of the headrest tilt 20 through connector tube 28. A stop pin 54 is rigidly secured to the motor slide bracket 50. Stop pin 54 is located to correspond with the notch 46 in the motor slide hinge 42.

At least one of the inward legs 26 (or the top connector tube 28) is connected to at least one of the bottom brackets 32 (or the bottom connector tube 34, or the back post 12) with an extension spring 56. Spring 56 biases the mechanism 10 to the closed position shown in FIG. 1. The motor 40 is sized to overcome this spring force to move the mechanism 10 from the closed position to the open position. More specifically, if a user desires to move the mechanism from the closed position of FIG. 1 to the open position of FIG. 3, he or she will engage the motor 40. While not shown, the motor 40 is operably connected to a switch or control that is operable by the user. The control for the motor 40 may be separate from, or integrated with, other controls associated with the chair. The shaft 38 of the motor extends, overcoming the biasing force of spring 56 and causing an upward force at pivot 44. This upward force moves the motor slide hinge 42 upwardly. As the motor slide hinge 42 moves upwardly, the stop pin 54 is rotated rearwardly and upwardly, caused by the upward force of motor slide hinge 42 and the pivot point 52. This movement also results in the corresponding movement of the motor slide bracket 50. The rotation of the motor slide bracket 50 operates to rotate the headrest tilt 20 about pivot 22. So, the motor 40 is used to provide selected adjustment of the angular position of the headrest tilt 20 with respect to the back frame post 12. To move the headrest tilt to the closed position, the motor controls are used to retract the shaft 38, and the spring 56 operates to pull the headrest tilts 20 to the closed position, until the headrest tilt 20 abuts stop 18.

Figure 4:
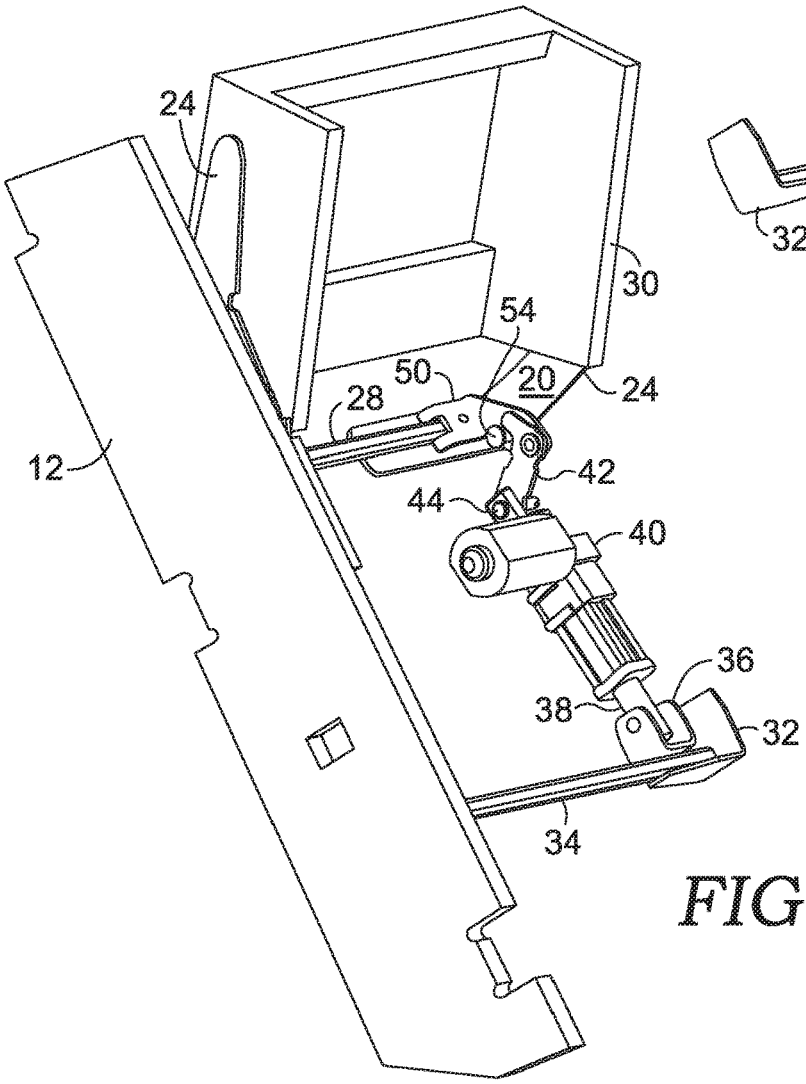
FIG. 4 is a perspective view similar to FIG. 3, but showing the release mechanism in a released condition.

Another feature of the mechanism 10 is the release configuration. As the headrest tilts 20 are moving to the closed position, objects may have moved into place behind the back insert 30. If an object is present, the pivotal coupling of the motor 40, motor slide hinge 42 and motor slide bracket 50 cooperate to allow the motor 40 to continue to operate, without imparting continued force to the rotation of the headrest tilts 20. More specifically, if an object is behind the back insert 30, it will operate to block movement of the headrest tilts 20, effectively preventing rotation about pivot 22. The motor 40 can continue to operate, moving pivot 44 downwardly. With the headrest tilts 20 prevented from movement, the motor slide bracket 50 will remain in place. The motor slide hinge 42 is still allowed to move, pivoting about pivot 52. This effectively moves the motor slide hinge 42 away from the stop pin 54, as seen in FIG. 4. The only remaining force acting against the object behind back insert 30 is imparted by the spring 56.

The mechanism 10 has been described above in a "frame-within-a-frame" environment. In other words, the back insert 30 nests within or between the back frame posts 12. The mechanism 10 could also be used in an environment where the back frame posts 12 extend only to approximately the area of pivot 22, with the back insert configured to extend essentially across the width of the chair on which it is placed.

Figure 6:
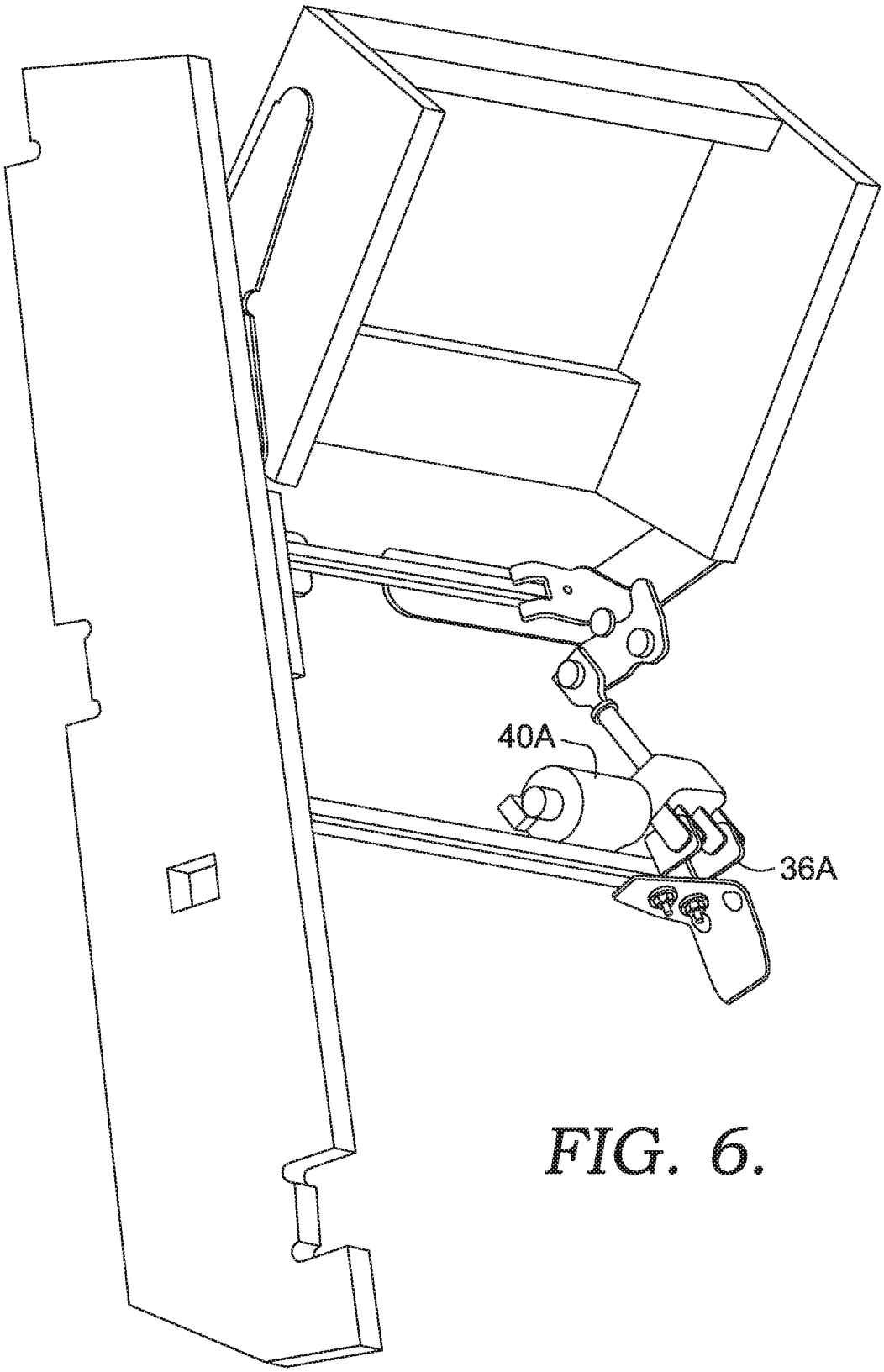
FIG. 6 is a perspective view showing an embodiment using a different motor.
Figure 7:
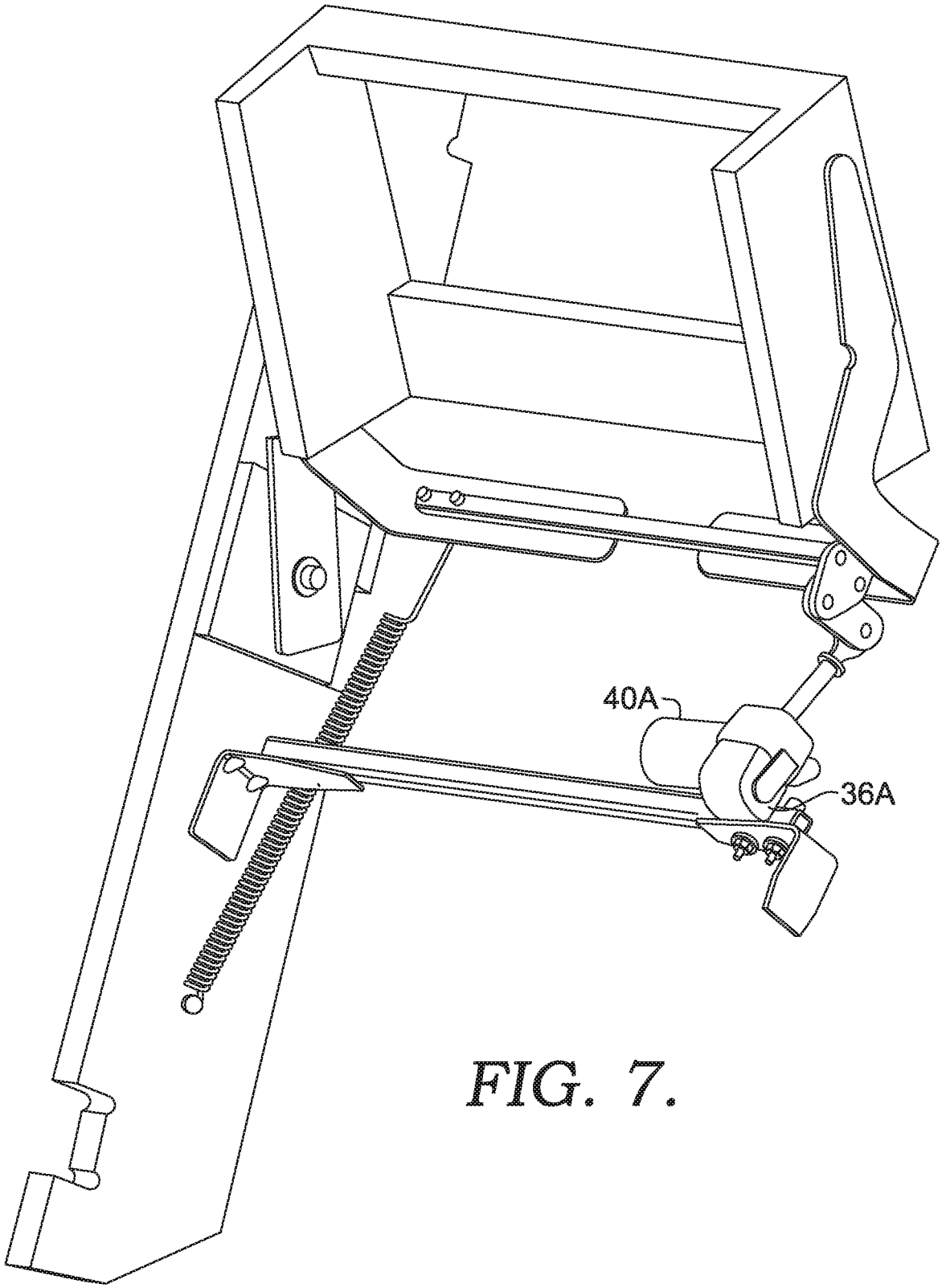
FIG. 7 is a view similar to FIG. 6, from a different angle.

An embodiment of the mechanism 10 showing the use of a different motor 40A is shown in FIGS. 6 and 7. The clevis 36A is configured differently from clevis 36 to accommodate the motor 40A. The remainder of the components of mechanism 10 is the same. As noted above, other motors, gas springs, or linear actuators could also be used in mechanism 10. As would be understood by those in the art, each different motor, gas spring or actuator may require slight modification in the mounting arrangement.

Figure 8:
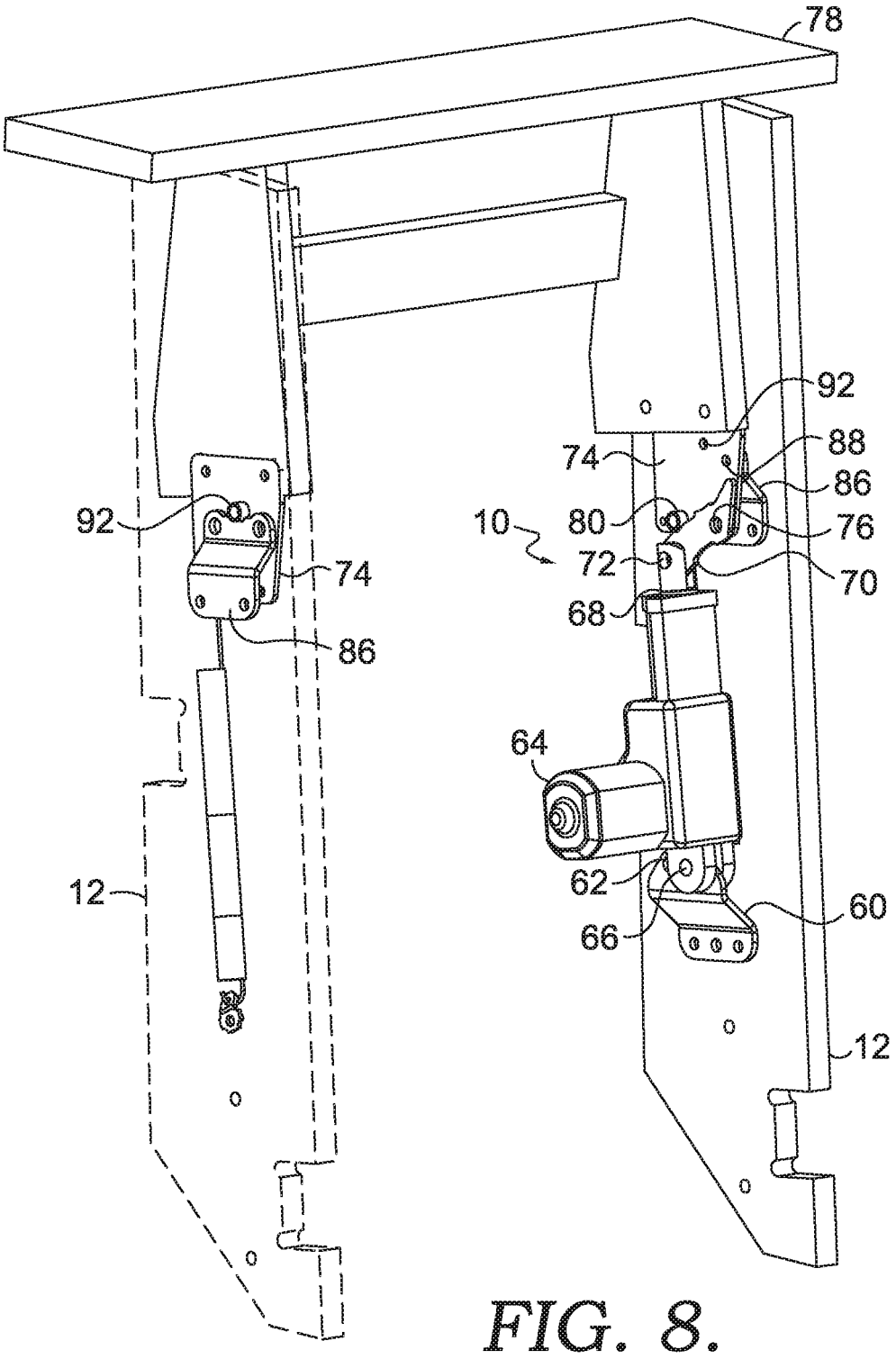
FIG. 8 is a perspective view of an exemplary headrest tilt mechanism in a closed position, with only a portion of a chair frame shown for clarity, in accordance with a different embodiment of the invention.
Figure 8A:
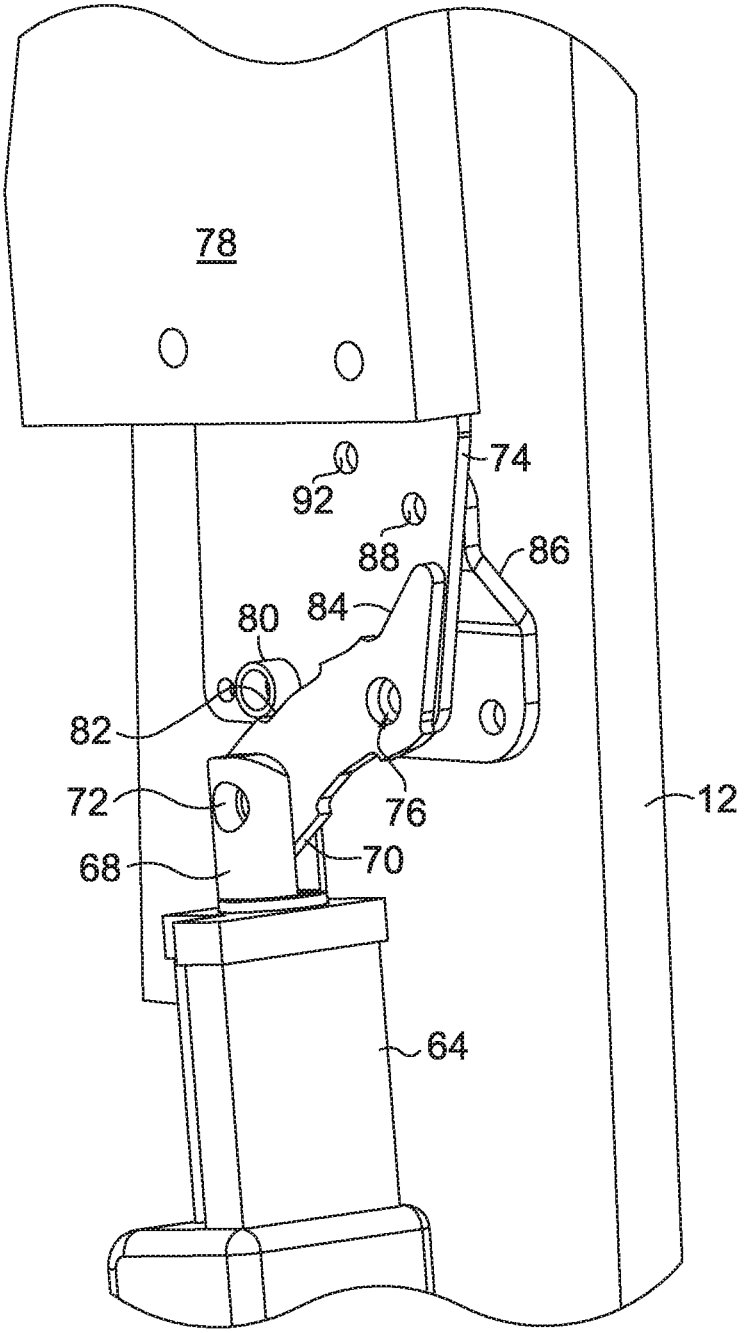
FIG. 8A is an enlarged view of a portion of FIG. 8 to show particular details of construction.
Figure 9:
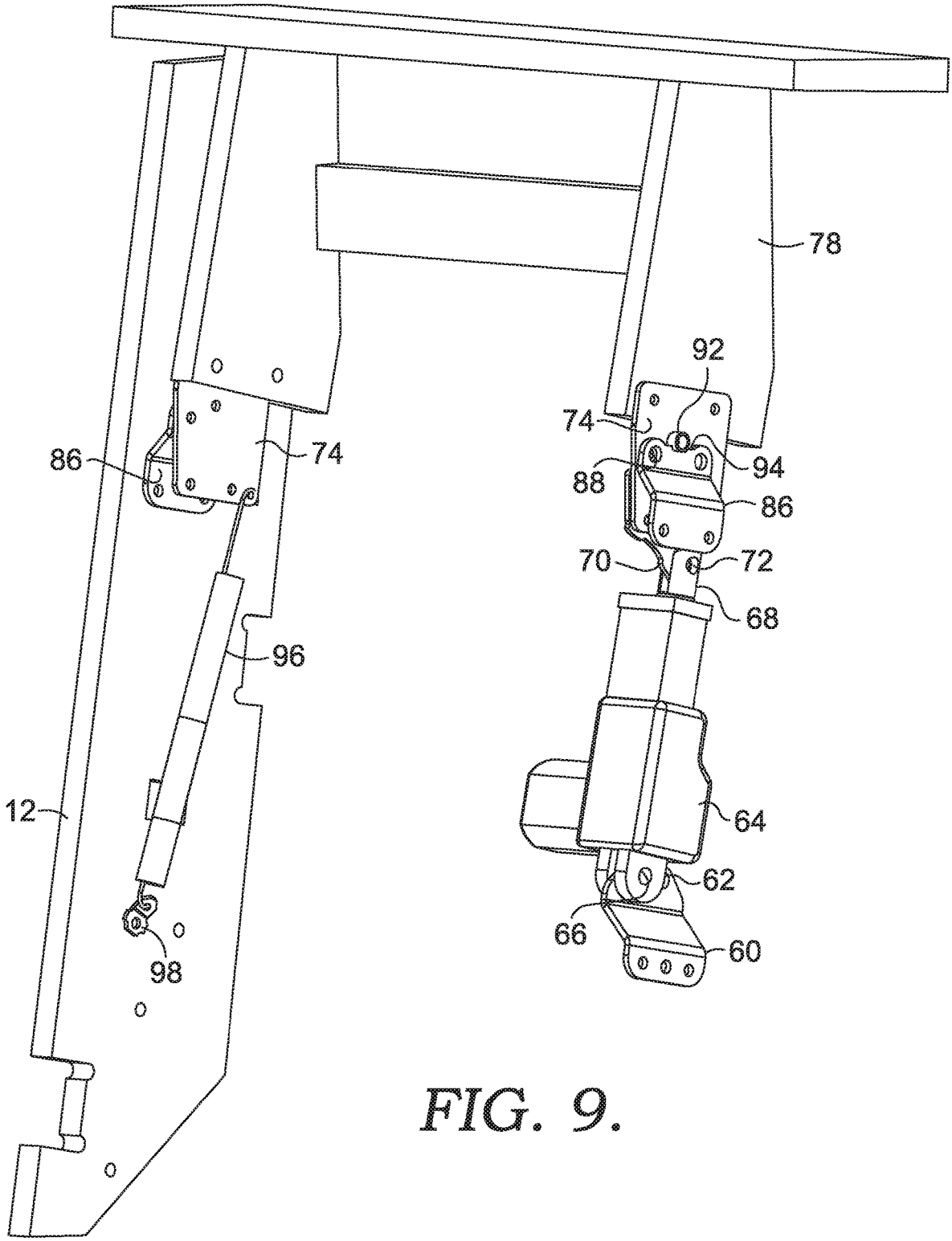
FIG. 9 is a perspective view of the headrest tilt mechanism of FIG. 8, with additional parts removed for clarity.
Figure 10:
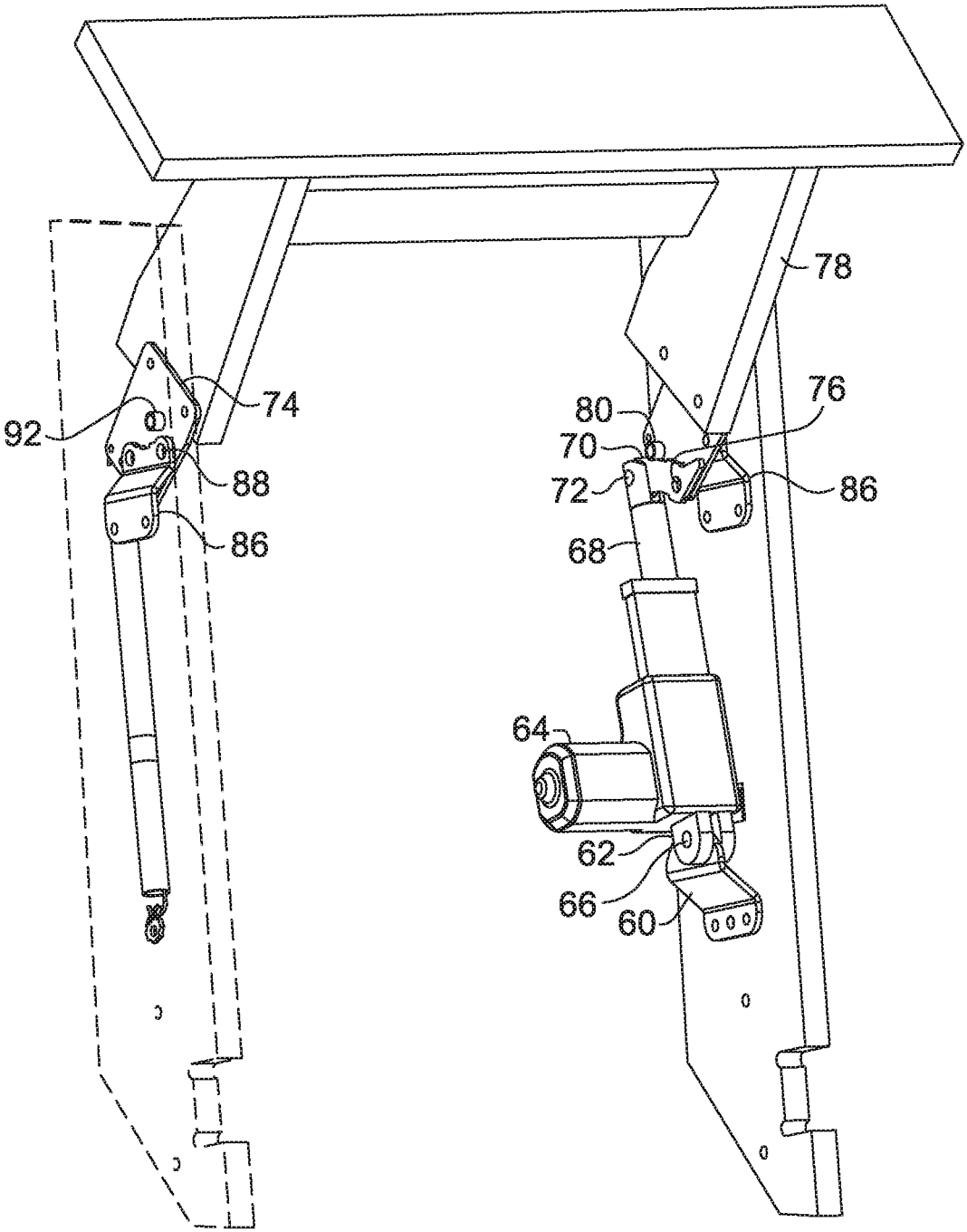
FIG. 10 is a perspective view of the headrest tilt mechanism of FIG. 8, shown in the open, or tilted, position.
Figure 11:
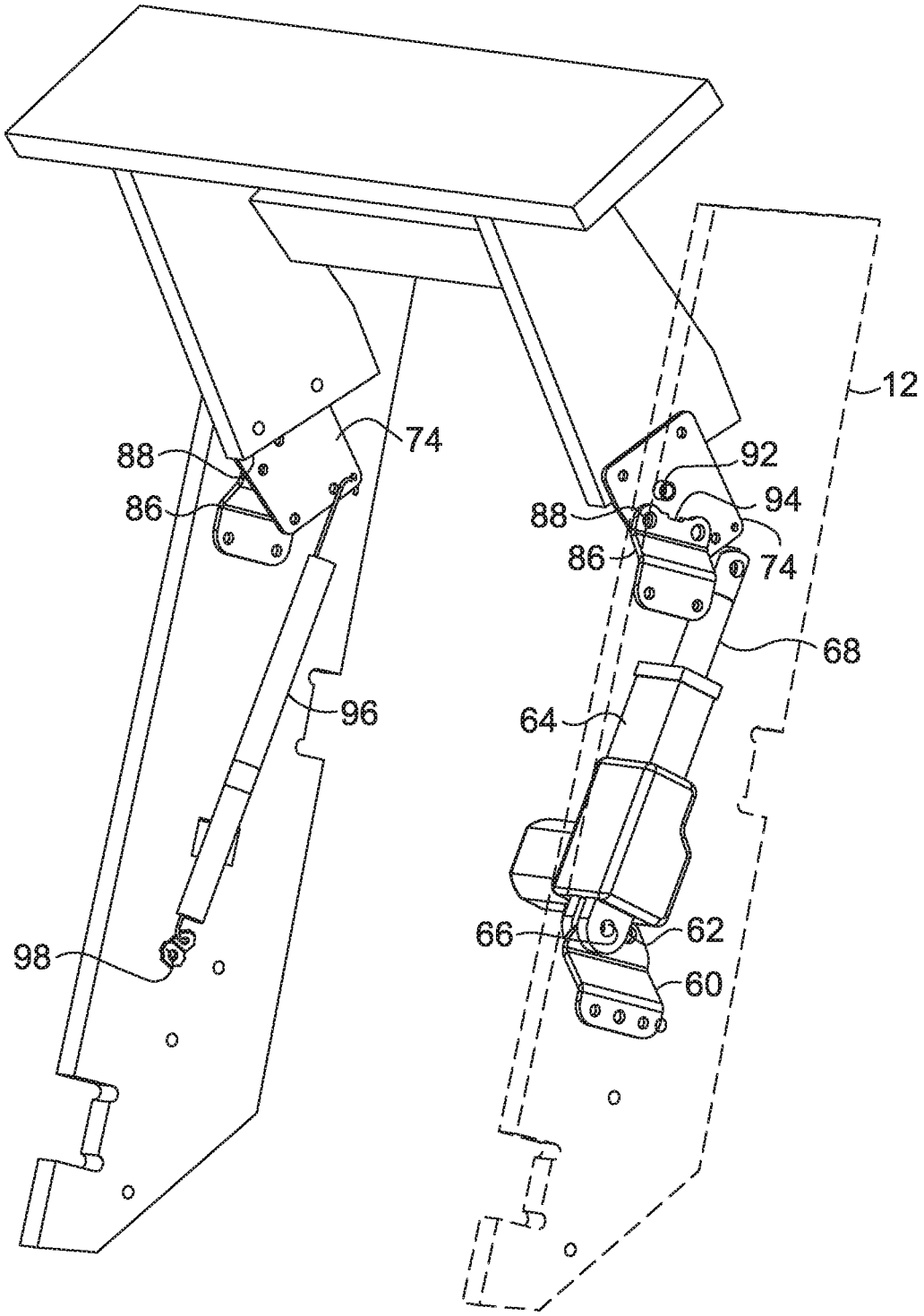
FIG. 11 is a view of the headrest tilt mechanism of FIG. 10, shown as a perspective view from a different angle.

A different embodiment of the mechanism 10 showing a slightly different configuration is shown in FIGS. 8-11. With initial reference to FIG. 8, the mechanism 10 is again mounted between a back frame post 12 and a back insert 78. More specifically, a motor bracket 60 is coupled to the frame post 12, such as by bolts, adhesives or screws, although other attachment mechanisms could certainly be used. Bracket 60 extends inwardly from the frame post 12 and has an upwardly extending tab that is coupled to a clevis 62 of a motor 64 at pivot 66. The opposite end of motor 64 has an extending shaft 68 that is pivotally coupled to a motor slide hinge 70 at pivot 72. Motor slide hinge 70 is shaped as shown and has a retaining notch 82, as best seen in FIG. 8A (similar to retaining notch 46 of FIGS. 1-5), and a retaining finger 84 (similar to retaining finger 48 of FIGS. 1-5). The motor slide hinge 70 is pivotally coupled to a back bracket 74 at pivot 76. Although not shown, the pivotal coupling can be made with a bolt, rivet or other pivotal attachment mechanism. Near this pivotal coupling, a cam 80 is fixed to the back bracket 74. The cam 80 generally rests within the retaining notch 82. The upper end of the back bracket 74 is fixedly coupled to the back insert 78, such that movement of the back bracket 74 results in movement of the back insert 78. As best seen in FIG. 9, the back bracket 74 is pivotally coupled to a side bracket 86 at pivot 88. Note that side bracket 86 has an unused hole spaced from pivot 88. Having two holes positioned in this location and geometry allows side brackets 86 to be used as either left-side or right-side interchangeably. With continued reference to FIG. 9, a locating stop 92 is coupled to back bracket 74 and protrudes outwardly toward side bracket 86. In the closed position, stop 92 rests within a notch 94 in side bracket 86. As best seen in FIG. 9, a side bracket 86 and a back bracket 74 are used to pivotally couple back frame post 12 to back insert 78 on the side opposite motor 64. A spring 96 extends from back bracket 74 to a mounting tab 98 coupled to back frame post 12. The operation of the mechanism 10 shown in FIGS. 8-11 operates substantially similarly to the operation described with respect to FIGS. 1-5 above, including the operation of the motor and spring return, use of the retaining finger, and the release operation.

Figure 12:
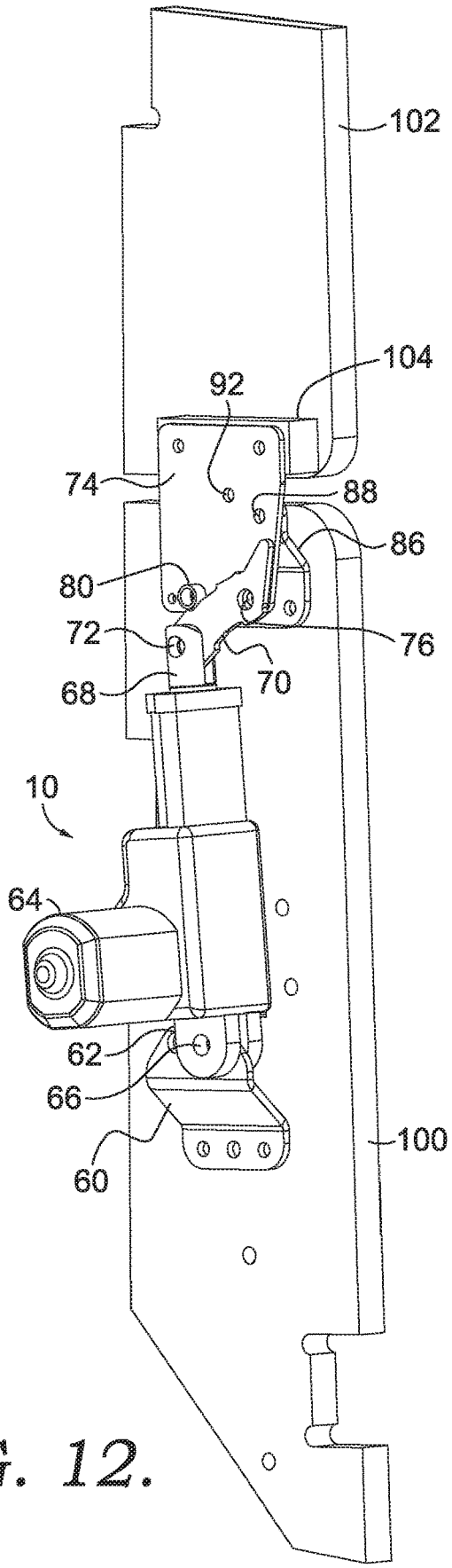
FIG. 12 is a perspective view of one side of an exemplary headrest tilt mechanism in a closed position, with only a portion of a chair frame shown for clarity, in accordance with a different embodiment of the invention.
Figure 13:
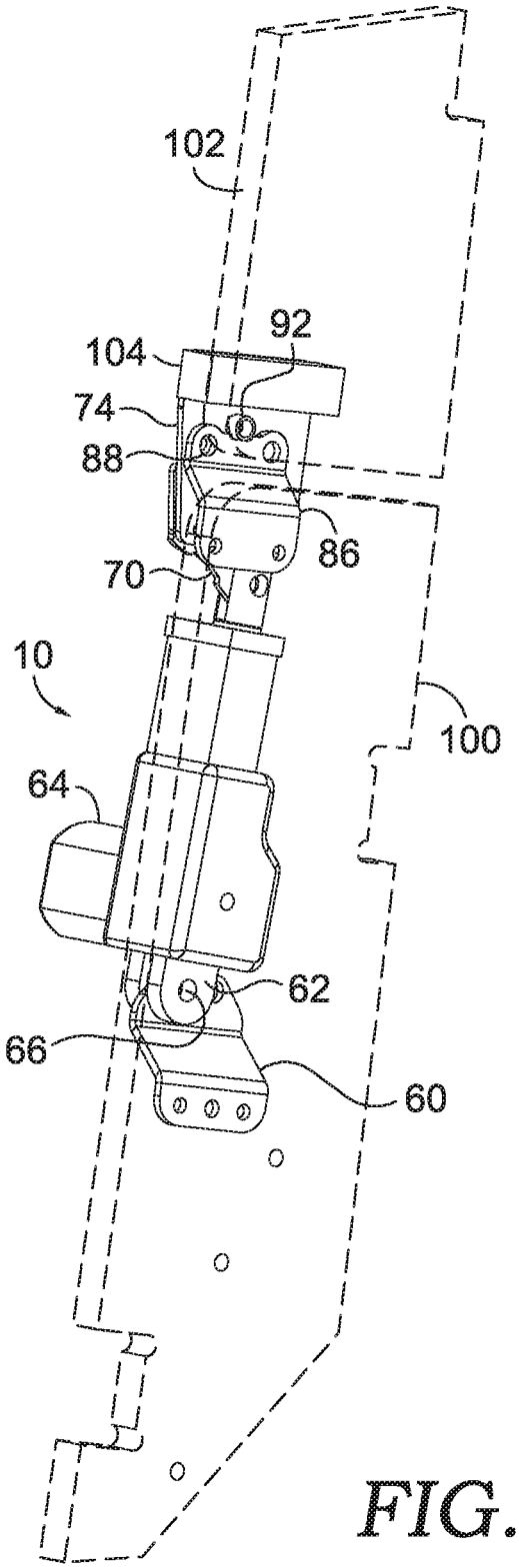
FIG. 13 is a view of the headrest tilt mechanism of FIG. 12, shown from a different angle, and with portions shown as "see through" for clarity.
Figure 14:
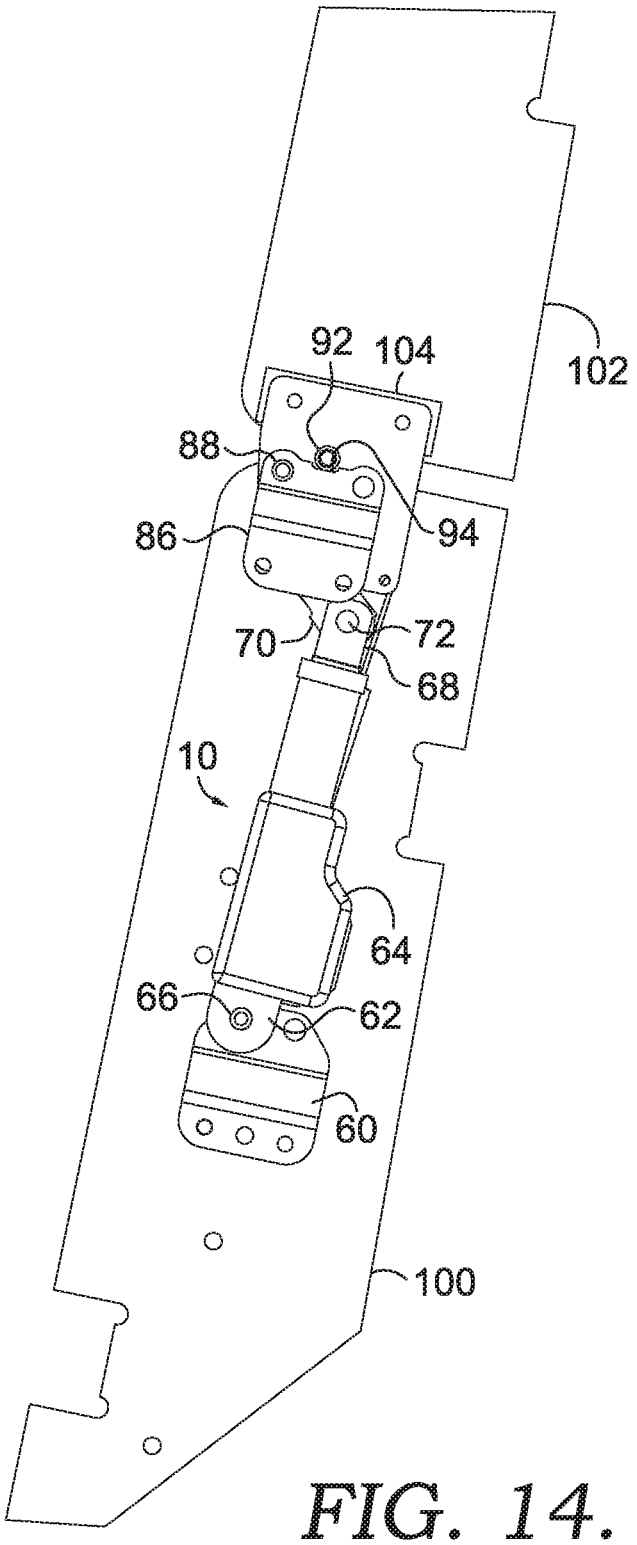
FIG. 14 is a side view of FIG. 13.

FIGS. 12-14 show a mechanism 10 that is similar to that described above with respect to FIGS. 8-11, but showing a "split-back" configuration. The mechanism 10 of FIGS. 12-14 has many of the same components as those described in FIGS. 8-11. In this configuration, however, the back frame is split into a lower back frame post 100 and an upper head rest frame 102. The motor bracket 60 is coupled to the lower back frame post 100. Instead of the back bracket 74 being coupled to the back insert 78, the back bracket 74 is coupled to the upper head rest frame 102 via a spacer block 104. This embodiment illustrates the use of mechanism 10 in a split-back configuration, as opposed to the frame within a frame configuration of FIGS. 8-11. The principle operation of the mechanism remains the same, but offers furniture manufacturers additional choices in styling.

Figure 15:
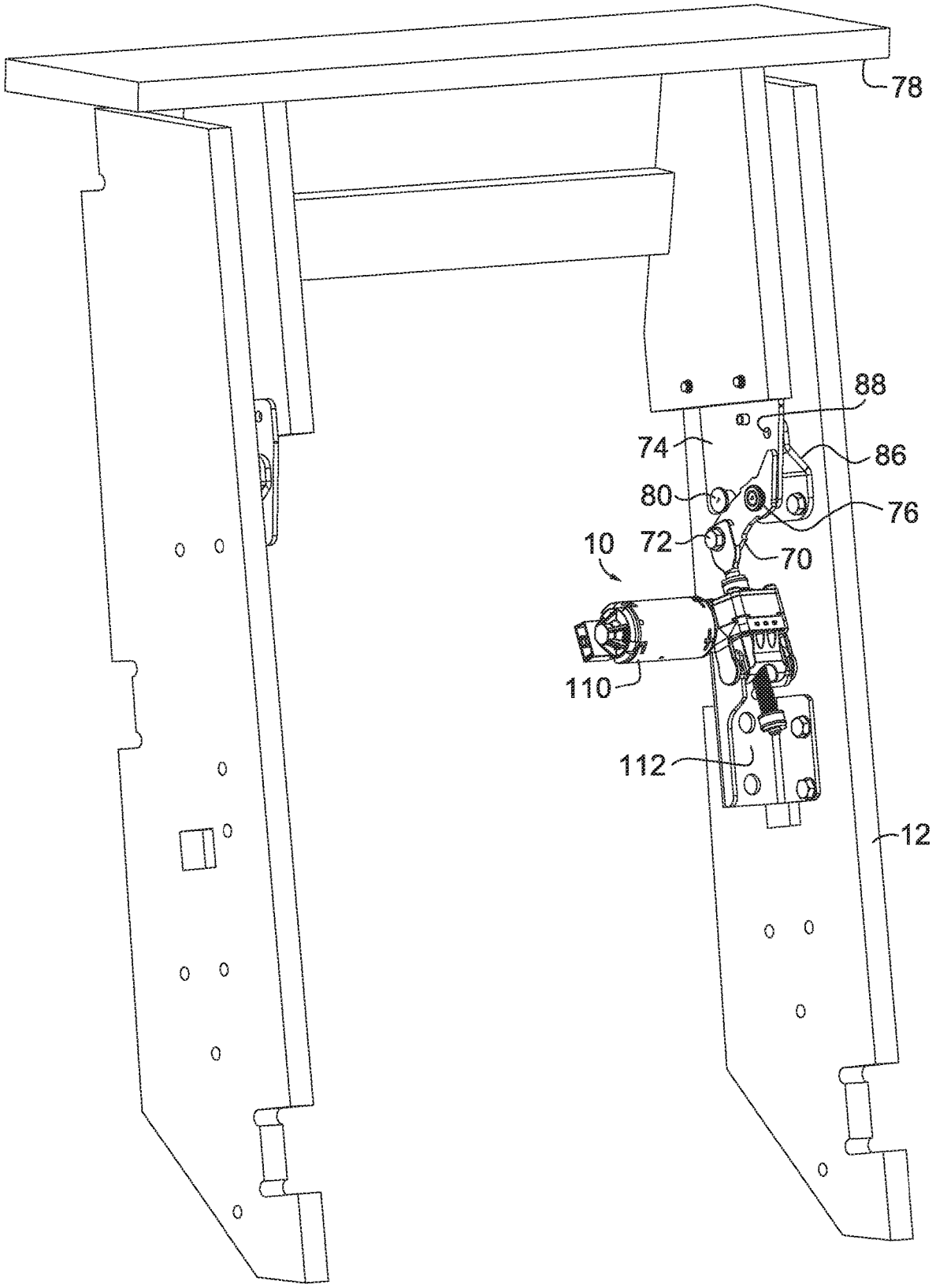
FIG. 15 is a perspective view of an exemplary headrest tilt mechanism in a closed position, with only a portion of a chair frame shown for clarity, in accordance with a different embodiment of the invention.

FIG. 15 illustrates the basics of mechanism 10 as shown and described with reference to FIGS. 8-14, but showing the use of a different motor 110 (which is the same motor as shown and described with respect to FIGS. 6 and 7 above). FIG. 15 illustrates that a number of different motors can be used while retaining the majority of the mechanism. As shown, a different motor bracket 112 is used to mount motor 110 to the back frame post 12. Additionally, the coupling between the motor 110 and motor slide hinge 70 may be slightly different, depending on the shaft configuration of the motor.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A headrest tilt mechanism for installation on a chair having a back frame, the headrest tilt mechanism comprising:

a back insert, framing an area of the chair to be independently pivoted;

at least one headrest tilt body coupled to the back insert, and coupled at a first pivot to the back frame of the chair, such that the at least one headrest tilt has a rotational range centered at the first pivot;

a lower connector tube coupled to the back frame of the chair below the back insert;

an actuator, having a base, an upper end, and a shaft;

a receiving element rigidly secured to the at least one headrest tilt body;

a rotational element being coupled at a second pivot to the at least one headrest tilt body and at a third pivot to the actuator upper end, wherein the second pivot point is spatially separated from the receiving element, wherein the rotational element is positioned relative to the receiving element such that a range of rotation for the rotational element around the second pivot is limited by contact with the receiving element;

the actuator base being coupled at a fourth pivot to the lower connector tube;

wherein the actuator can be actuated to pivot the at least one headrest tilt body from a closed to an open position by imparting force via the rotational element upon the receiving element, such that the rotational element makes direct contact with the receiving element while the at least one headrest tilt body is pivoting from the closed to the open position.

2. The mechanism of claim 1, wherein the actuator can be actuated by extending the actuator shaft.

3. The mechanism of claim 1, wherein the rotational element is arranged to rotate relative to both the actuator upper end and the receiving element as the actuator is actuated.

4. The mechanism of claim 1, further comprising a spring having a first end and a second end, the first end coupled to the back frame of the chair and the second end coupled to the at least one head rest tilt body.

5. The mechanism of claim 4, wherein the spring provides a spring force which biases the mechanism to the closed position.

6. The mechanism of claim 5, wherein the actuator is sized to overcome the spring force.

7. The mechanism of claim 1, wherein the actuator is one of a motor, a linear actuator, or a gas spring.

8. The mechanism of claim 1, wherein the at least one headrest tilt body is shaped to include an upwardly extending leg and an inwardly extending leg, wherein the upwardly extending leg is coupled to the back insert and the inwardly extending leg is coupled to an upper connector tube such that the at least one headrest tilt body is secured.

9. The mechanism of claim 1, further comprising a locating stop protruding inwardly from the back frame such that, within a range of rotation of the at least one headrest tilt body relative to the back frame, the locating stop contacts the at least one headrest tilt body.

10. The mechanism of claim 1, further comprising at least one stop protruding outward from the at least one headrest tilt body and at least one side bracket secured inwardly to the back frame such that, within a range of rotation of the at least one headrest tilt body relative to the back frame, the stop contacts the at least one side bracket.

* * * * *